US010811176B2

(12) United States Patent
Futamata et al.

(10) Patent No.: US 10,811,176 B2
(45) Date of Patent: Oct. 20, 2020

(54) DUST CORE

(71) Applicant: TDK CORPORATION, Tokyo (JP)

(72) Inventors: Yousuke Futamata, Tokyo (JP); Ryoma Nakazawa, Tokyo (JP); Takeshi Takahashi, Tokyo (JP); Junichi Shimamura, Tokyo (JP)

(73) Assignee: TDK CORPORATION, Tokyo (JP)

( * ) Notice: Subject to any disclaimer, the term of this patent is extended or adjusted under 35 U.S.C. 154(b) by 325 days.

(21) Appl. No.: 15/913,964

(22) Filed: Mar. 7, 2018

(65) Prior Publication Data

US 2018/0261364 A1 Sep. 13, 2018

(30) Foreign Application Priority Data

Mar. 9, 2017 (JP) ..... 2017-045484

(51) Int. Cl.

| | |
|---|---|
| ***H01F 27/28*** | (2006.01) |
| ***H01F 1/147*** | (2006.01) |
| ***H01F 3/00*** | (2006.01) |
| ***H01F 1/26*** | (2006.01) |
| ***H01F 3/08*** | (2006.01) |
| ***H01F 1/33*** | (2006.01) |
| *H01F 1/24* | (2006.01) |

(52) U.S. Cl.

CPC ..... *H01F 1/14766* (2013.01); *H01F 1/26* (2013.01); *H01F 1/33* (2013.01); *H01F 3/00* (2013.01); *H01F 3/08* (2013.01); *H01F 27/28* (2013.01); *H01F 1/24* (2013.01)

(58) Field of Classification Search

CPC ..... H01F 1/14766; H01F 27/28; H01F 1/26; H01F 3/08; H01F 1/33; H01F 3/00; H01F 1/24; H01F 1/0306; H01F 41/0246

See application file for complete search history.

(56) References Cited

U.S. PATENT DOCUMENTS

| | | | | |
|---|---|---|---|---|
| 9,390,845 | B2 * | 7/2016 | Rowe | H01F 1/0018 |
| 9,431,159 | B2 * | 8/2016 | Rowe | H01F 1/33 |
| 2008/0044679 | A1 | 2/2008 | Maeda et al. | |
| 2010/0028195 | A1 | 2/2010 | Maeda et al. | |
| 2010/0044618 | A1 | 2/2010 | Ishimine et al. | |
| 2010/0239879 | A1 | 9/2010 | Kawano et al. | |
| 2012/0239879 | A1 * | 9/2012 | Kawakami | G06F 21/50 711/113 |

FOREIGN PATENT DOCUMENTS

| | | | |
|---|---|---|---|
| CN | 101091226 A | | 12/2007 |
| JP | 2007214366 A | * | 8/2007 |
| JP | 2008305823 A | * | 12/2008 |

(Continued)

*Primary Examiner* — Tuyen T Nguyen
(74) *Attorney, Agent, or Firm* — Oliff PLC

(57) ABSTRACT

A dust core includes a metal magnetic material, a resin, an insulation film, and an intermediate layer. The insulation film covers the metal magnetic material. The intermediate layer exists between the insulation film and the metal magnetic material and contacts therebetween. The metal magnetic material includes 85 to 99.5 wt % of Fe, 0.5 to 10 wt % of Si, and 0 to 5 wt % of other elements, with respect to 100 wt % of the entire metal magnetic material. The intermediate layer includes a Fe—Si—O based oxide. The insulation film includes a Si—O based oxide.

7 Claims, 5 Drawing Sheets

(56) References Cited

FOREIGN PATENT DOCUMENTS

| | | | |
|---|---|---|---|
| JP | 2009-070914 | A | 4/2009 |
| JP | 2009-120915 | A | 6/2009 |
| JP | 2009-147176 | A | 7/2009 |
| JP | 2010-62424 | A | 3/2010 |
| JP | 5190331 | B2 | 4/2013 |
| JP | 6075605 | B2 | 2/2017 |

* cited by examiner

DUST CORE

BACKGROUND OF THE INVENTION

1. Field of the Invention

The present invention relates to a dust core.

2. Description of the Related Art

Motors and coil devices, such as inductors, choke coils, and transformers, have been required to be downsized, and widely used is thereby a metal magnetic material whose saturation magnetic flux density is larger than that of ferrite and whose DC superposition characteristics are maintained until high magnetic field. Dust cores thereof are expected to be used in various environments and are thereby desired to have improved reliabilities.

Among the reliabilities, corrosion resistance is particularly desired to be improved. This is because most of dust cores currently used comprise Fe based alloy particles.

Patent Document 1 discloses that corrosion resistance is improved by containing Cr as a metal magnetic material, but if Cr must be contained, the range of material selection is narrowed.

Patent Document 2 discloses that a metal magnetic material is coated with inorganic coat (phosphate), but phosphate has a low toughness, and a coating film may be broken when molding pressure is increased.

Patent Document 3 discloses that corrosion resistance is improved by coating a magnetic product with ceramics and resin, but the method of Patent Document 3 requires a dust core to be heated at a high temperature of 800° C. or more. If the dust core includes an insulated copper wire or so, the insulation of the wire may be broken.

Patent Document 1: JP2010062424 (A)
Patent Document 2: JP2009120915 (A)
Patent Document 3: JP5190331 (B2)

SUMMARY OF THE INVENTION

The present invention has been achieved under such circumstances. It is an object of the invention to provide a dust core excelling in corrosion resistance.

To achieve the above object, the dust core according to the present invention comprises:

a metal magnetic material;

a resin;

an insulation film covering the metal magnetic material; and an intermediate layer existing between the insulation film and the metal magnetic material and contacting therebetween, wherein the metal magnetic material comprises 85 to 99.5 wt % of Fe, 0.5 to 10 wt % of Si, and 0 to 5 wt % of other elements, with respect to 100 wt % of the entire metal magnetic material, wherein the intermediate layer comprises a Fe—Si—O based oxide, and wherein the insulation film comprises a Si—O based oxide.

The dust core according to the present invention has the above features, and can thereby have an improved corrosion resistance.

Preferably, $6.0<W_{Fe}/W_{Si}<9.0$ is satisfied, where $W_{Fe}$ (wt %) is a Fe content of the intermediate layer, and $W_{Si}$ (wt %) is a Si content of the intermediate layer, provided that a total of the Fe content and the Si content of the intermediate layer is 100 wt %.

Preferably, $0<D<50$ nm is satisfied, where "D" (nm) is a thickness of the intermediate layer.

DETAILED DESCRIPTION OF THE PREFERRED EMBODIMENT

Hereinafter, an embodiment of the present invention is described based on figures.

Figure 1:
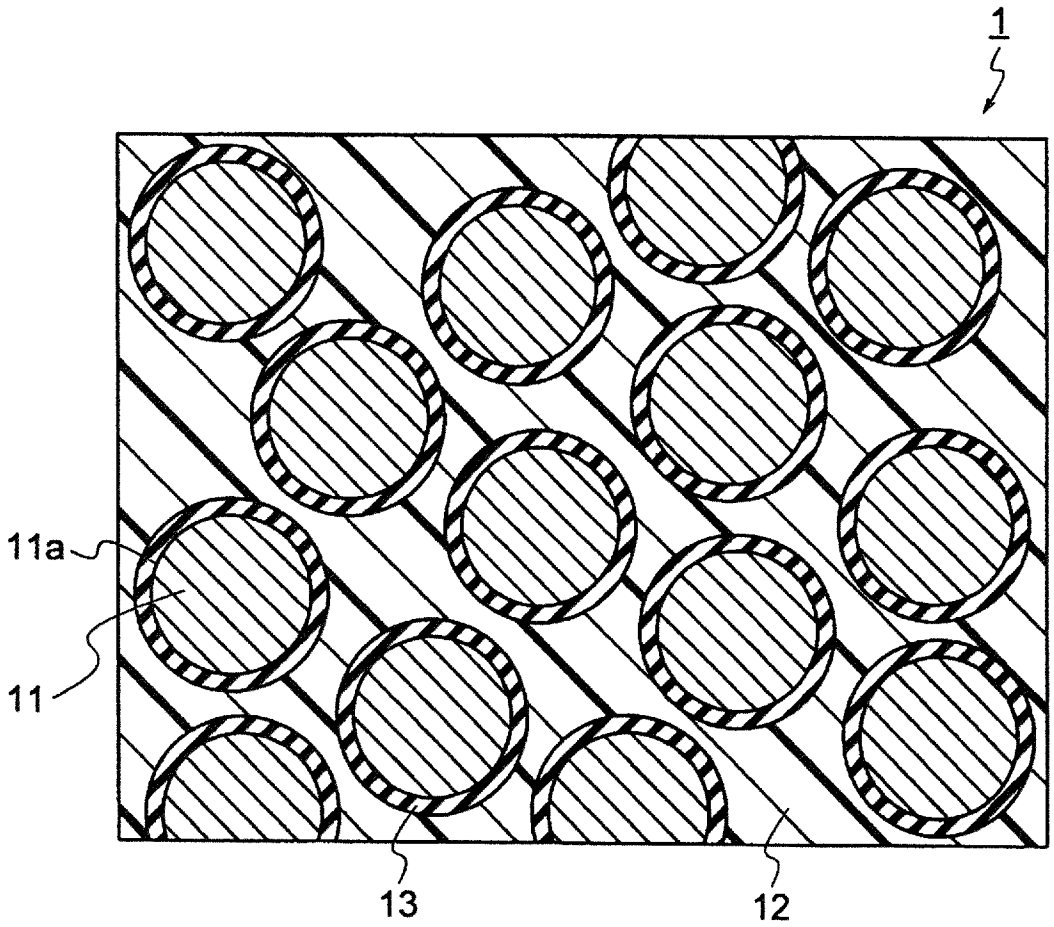
FIG. 1 is a schematic view of a cross section of a dust core according to an embodiment of the present invention.

As shown in FIG. 1, a dust core 1 according to the present embodiment includes a metal magnetic material 11 and a resin 12. Moreover, the dust core 1 includes insulation films 13 coating the metal magnetic material 11.

With respect to 100 wt % of the entire metal magnetic material, the metal magnetic material 11 according to the present embodiment contains 85 to 99.5 wt % of Fe, 0.5 to 10 wt % of Si, and 0 to 5 wt % of other elements. The amount of other elements may be 0 wt %. That is, the metal magnetic material 11 may comprise only Fe and Si. Incidentally, other elements may be any elements, such as Ni and Co.

The resin 12 may be any resin, such as epoxy resin of cresol novolac etc. and/or imide resin of bismaleimide etc.

Any amount of the metal magnetic material 11 and the resin 12 may be contained in the dust core 1. With respect to the whole of the dust core 1, the amount of the metal magnetic material 11 is preferably 90 wt % to 98 wt %, and the amount of the resin 12 is preferably 2 wt % to 10 wt %.

As shown in FIG. 1, the insulation films 13 are characterized by coating the metal magnetic material 11. Moreover, the insulation films 13 comprise a Si—O based oxide.

The insulation film 13 may not coat the whole of the metal magnetic material 11, but should coat 90% or more of the whole of the metal magnetic material 11. This feature can enhance rust-proof effect.

The Si—O based oxide may be any oxide, such as a Si oxide like $SiO_2$ and a composite oxide including Si and other elements. The insulation film 13 has any film thickness, such as 10 to 300 nm. Moreover, the insulation film 13 comprises one layer in FIG. 1, but may comprise two or more layers.

Figure 2:
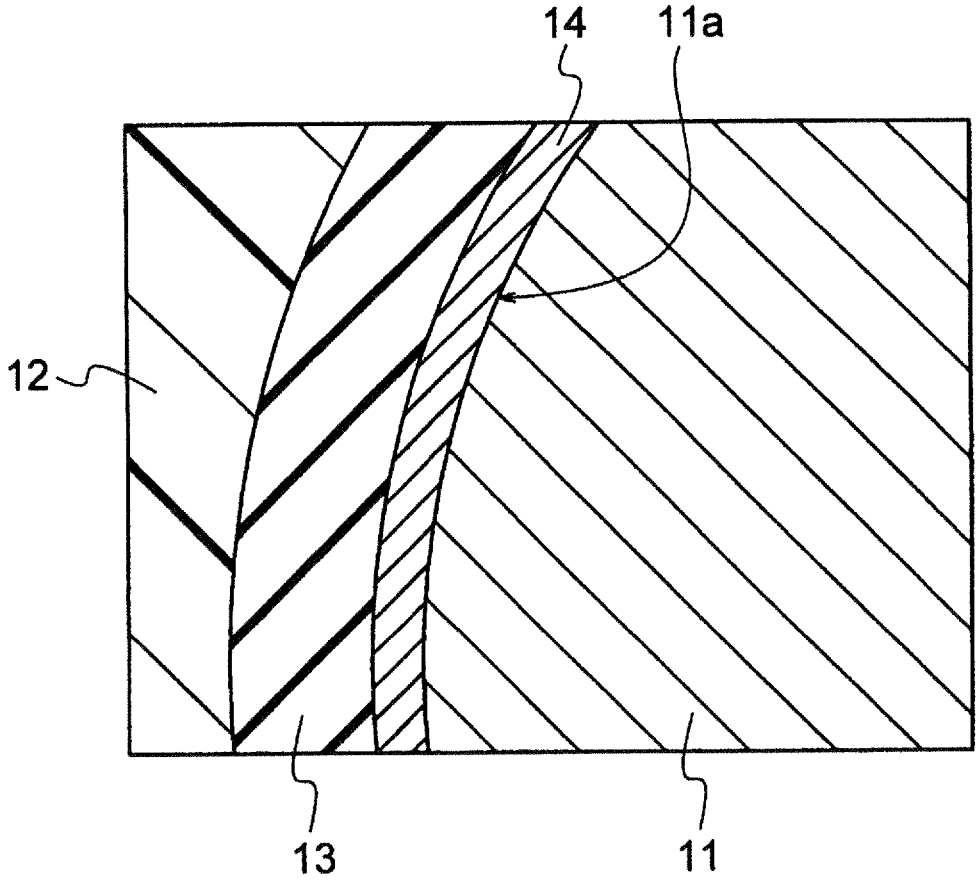
FIG. 2 is a schematic view near a surface of a metal magnetic material constituting the dust core shown in FIG. 1.

FIG. 2 is an enlarged schematic view near the surface of the metal magnetic material 11 of FIG. 1. In the dust core 1 according to the present embodiment, an intermediate layer 14 contacting with the insulation film 13 and a surface 11*a* of the metal magnetic material 11 is present between the metal magnetic material 11 and the insulation film 13. Incidentally, the intermediate layer 14 is not illustrated in FIG. 1 and is illustrated in only FIG. 2, but this does not necessarily mean that the intermediate layers 14 are thinner than the insulation films 13. That is, the intermediate layers 14 may be thicker than the insulation films 13.

The intermediate layers 14 comprise a Fe—Si—O based oxide. The Fe—Si—O based oxide may be any oxide containing 50 wt % or more of Fe, 1 wt % or more of Si, and 5 wt % or more of O, with respect to 100 wt % of the whole of the intermediate layers 14. The intermediate layers 14 may comprise elements other than Fe, Si, and O.

The dust core 1 according to the present embodiment has the above feature of the intermediate layers 14 comprising a Fe—Si—O based oxide, and can thereby have an improved corrosion resistance. The reason why corrosion resistance is improved is considered that a joint property between the metal magnetic material 11 comprising a Fe—Si based alloy and the insulation film 13 comprising a Si—O based oxide is improved by forming the intermediate layer 14 comprising a Fe—Si—O based oxide therebetween. The improvement in joint property is considered to lessen peeling of the insulation film 13 during die molding mentioned below and to improve corrosion resistance.

Preferably, $6.0<W_{Fe}/W_{Si}<9.0$ is satisfied, where $W_{Fe}$ (wt %) is a Fe content of the intermediate layer 14, and $W_{Si}$ (wt %) is a Si content of the intermediate layer 14, provided that a total of the Fe content and the Si content of the intermediate layer 14 is 100 wt %. When $W_{Fe}/W_{Si}$ is within the above range, a joint strength between the metal magnetic material 11 and the insulation film 13 is further improved. More preferably, $6.1\leq W_{Fe}/W_{Si}\leq 8.9$ is satisfied. Still more preferably, $6.3\leq W_{Fe}/W_{Si}\leq 8.6$ is satisfied. $W_{Fe}$ and $W_{Si}$ are an average content measured by randomly determining at least five, preferably 10 or more, measurement points.

The intermediate layer 14 may not contact with the entire surface 11*a* of the metal magnetic material 11, but should contact with 80% or more of the entire surface 11*a* of the metal magnetic material 11.

The intermediate layer 14 may have any thickness, but $0<D<50$ nm is preferably satisfied, where "D" is a thickness of the intermediate layer 14. There is no lower limit of "D", but it is considered that the intermediate layer 14 does not exist if "D" is less than 1 nm. "D" is an average thickness measured by randomly determining at least five, preferably 10 or more, measurement points. When $0<D<50$ nm is satisfied, it is possible to prevent the lowering of initial permeability $\mu_i$ due to existence of the intermediate layer 14.

A method of manufacturing a dust core 1 according to the present embodiment is described below, but the dust core 1 is not limited to being manufactured by the following method.

First, metal particles to be a metal magnetic material 11 comprising a Fe—Si based alloy are manufactured. The metal particles are manufactured by any method, such as gas atomization method and water atomization method. The metal particles have any particle size and any circularity, but their particle size preferably has a median (D50) of 1 μm to 100 μm because a high permeability is obtained.

Next, formed is an intermediate layer 14 contacting with a surface 11*a* of the metal magnetic material 11 and comprising a Fe—Si—O based oxide. The intermediate layer 14 is formed by any method, such as a gradual oxidation treatment of the metal magnetic material 11 comprising a Fe—Si based alloy. The gradual oxidation treatment may be carried out by any method, such as a heating method at 600° C. to 800° C. for 0.5 to 10 hours in air.

Next, the metal magnetic material 11 is coated to form an insulation film 13 comprising a Si—O based oxide. The metal magnetic material 11 is coated by any method, such as a method of applying an alkoxysilane solution to the metal magnetic material 11 with the intermediate layer 14. The alkoxysilane solution is applied to the metal magnetic material 11 by any method, such as wet spray. The alkoxysilane is any kind, such as trimethoxysilane. The alkoxysilane solution has any concentration, but preferably has a concentration of 50 wt % to 95 wt %. The alkoxysilane solution has any solvent, such as water and ethanol.

The powder after wet spray is subjected to a heat treatment, and the insulation film 13 comprising a Si—O based oxide is thereby formed. The heat treatment may be carried out with any conditions, and is for example carried out at 800° C. to 850° C. for 1 to 3 hours in air.

Next, a resin solution is prepared. The resin solution may be added with a curing agent in addition to the above-mentioned epoxy resin and/or imide resin. The curing agent may be any agent, such as epichlorohydrin. The resin solution has any solvent, but preferably has a volatile solvent, such as acetone and ethanol. Preferably, a total concentration of the resin and the curing agent is 0.01 to 0.1 wt % with respect to 100 wt % of the whole of the resin solution.

Next, the resin solution and the powder with the intermediate layer 14 and the insulation film 13 are mixed, and granules are obtained by volatilizing the solvent of the resin solution. The resulting granules may be filled in a die as they are, but may be filled in a die after being sized. The resulting granules may be sized by any method, such as a method using a mesh whose mesh size is 45 to 500 μm.

Next, the resulting granules are filled in a die having a predetermined shape and are pressed, and a pressed powder is obtained. The granules are pressed at any pressure, such as 600 to 1500 MPa.

The manufactured pressed powder is subjected to a heat curing treatment, and a dust core is obtained. The heat curing treatment is carried out with any conditions. For example, the heat curing treatment is carried out at 150 to 220° C. for 1 to 10 hours. Moreover, the heat curing treatment is carried out in any atmosphere, such as air.

The dust core according to the present embodiment and a method of manufacturing it are described above, but the dust core and the method of manufacturing it of the present invention are not limited to the above-mentioned embodiment. Incidentally, the dust core of the present invention may be a soft magnetic dust core.

The dust core of the present invention is used for any purpose, such as for coil devices of inductors, choke coils, transformers, etc.

EXAMPLES

Hereinafter, the present invention is described based on more detailed examples, but is not limited thereto.

As a metal magnetic material, manufactured were Fe—Si based alloy particles where Si/Fe=4.5/95.5 was satisfied by weight ratio and the total amount of Fe and Si was 99 wt %. Incidentally, the median (D50) of particle sizes of the Fe—Si based alloy particles was 30 μm.

Next, a gradual oxidation treatment was carried out at 600 to 845° C. in air so as to prepare an intermediate layer contacting with the metal magnetic material and comprising a Fe—Si—O based oxide. Here, the gradual oxidation treatment time was controlled within a range of 0.5 to 10 hours so as to have the thickness "D" of the intermediate layer shown in Table 1 and Table 2. Moreover, the gradual oxidation temperature was set to 600 to 845° C. so as to change Fe—Si—O composition of the intermediate layer.

On the other hand, no gradual oxidation treatment was carried out in Comparative Example 1 of Table 1.

In order that an insulation film comprising a Si—O based oxide was formed on the resulting powder, 2.0 wt % of an alkoxysilane solution was wet sprayed against 100 wt % of the metal magnetic material. Incidentally, the alkoxysilane solution was 50 wt % solution of trimethoxysilane. The wet spray was carried out by 5 mL/min.

Next, the powder after the wet spray was heated at 800° C. for 10 hours in air, and an insulation film comprising a Si—O based oxide was formed. Hereinafter, a metal magnetic material with the intermediate layer and the insulation film was referred to as a coated powder. Incidentally, the insulation film of the coated powder had about 100 nm in all of Examples and Comparative Examples.

Next, a resin solution was formed by mixing an epoxy resin, a curing agent, an imide resin, and an acetone. The epoxy resin was cresol novolac. The curing agent was epichlorohydrin. The imide resin was bismaleimide. Each of the components was mixed so that a weight ratio of the epoxy resin, the curing agent, and the imide resin was 96:3:1, and that a total of the epoxy resin, the curing agent, and the imide resin was 4 wt % with respect to 100 wt % of the whole of the resin solution.

The above-mentioned coated powder was mixed with the above-mentioned resin solution. Next, granules were obtained by volatilizing the acetone. Next, the granules were sized using a mesh whose mesh size was 355 μm. The resulting granules were filled in a toroidal die whose outer diameter was 17.5 mm and inner diameter was 11.0 mm and were pressed at 980 MPa, and a pressed powder was obtained. The granules were filled so that the weight of the pressed powder was 5 g. Next, a heat curing treatment was carried out by heating the resulting pressed powder at 200° C. for 5 hours in air, and a dust core was obtained. The amount of the resin mixed was determined so that the amount of the metal magnetic material was about 97 wt % with respect to 100 wt % of a dust core finally obtained. Incidentally, the required number of dust cores was prepared to conduct all of the following measurements.

Figure 3:
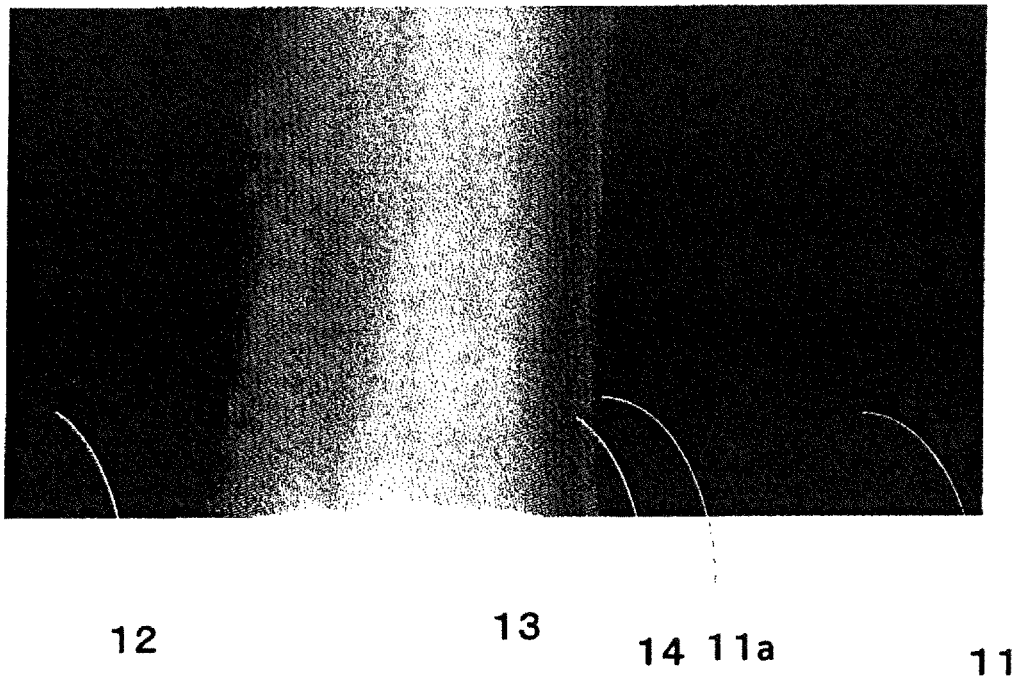
FIG. 3 is a TEM image obtained by TEM observation near a surface of a metal magnetic material.

The resulting dust cores were cut and polished, and a cross section of the dust cores was exposed. The exposed cross section was drilled by Focused Ion Beam (FIB) so as to cut out a flake whose area was 1 μm×1 μm and thickness was 100 nm. The resulting flake was observed by TEM and subjected to an image analysis in a visual field of 500 nm×500 nm. FIG. 3 is an actual result of image analysis (TEM observation) of Example 6.

The metal magnetic material was observed by TEM-EDS. In the metal magnetic material, elements constituting it, such as Fe and Si, were detected, but oxygen was hardly detected. As shown in the TEM image of FIG. 3, the metal magnetic material had the darkest visual field of portions contained in the coated powder.

The insulation film was observed by TEM-EDS. In the insulation film, elements constituting a Si—O based oxide, such as Si and O, were observed. As shown in the TEM image of FIG. 3, the insulation film had the brightest visual field of portions contained in the coated powder.

The intermediate layer was observed by TEM-EDS. The intermediate layer was in contact with the surface of the metal magnetic material and was present between the metal magnetic material and the insulation film. The contrast of the intermediate layer was about between the metal magnetic material and the insulation film.

Moreover, the intermediate layer was subjected to composition analysis. Measurement objects were set to Fe and Si, and quantitative analysis was carried out at 10 points determined randomly from the intermediate layer. $W_{Fe}/W_{Si}$ was calculated, where $W_{Fe}$ (wt %) was an average value of Fe concentrations of the measurement points, and $W_{Si}$ (wt %) was an average value of Si concentrations of the measurement points.

Moreover, a thickness (D) of the intermediate layer was calculated. 10 measurement points were set randomly on the surface of the metal magnetic material. Then, a perpendicular line was drawn from each of the measurement points toward the intermediate layer, and a length of the perpendicular line in the intermediate layer was considered to be a thickness of the intermediate layer at the measurement point. Then, an average of the thicknesses of the intermediate layer at each of the measurement points was considered to be $D_c$.

Next, a saltwater spray test was carried out for each of the dust cores so as to evaluate corrosion resistance thereof. The saltwater spray test was carried out in a saltwater spray test container of W900 mm, D600 mm, and H350 mm by 1.5±0.5 mL/h (at 80 $cm^2$). With these conditions, the saltwater spray test was carried out at 35° C. for 24 hours. After the saltwater spray, a measurement section of 3 mm×3 mm was set at 10 points. Each of the measurement sections was photographed by a camera attached to an optical microscope (50 times magnification), and a rust area ratio was calculated at each of the measurement sections. Then, calculated was an average of the rust area ratios at the 10 measurement sections. An average of the rust area ratios of 15.0% or less was considered to be good. Then, an average of the rust area ratios of 10.0% or less was considered to be better, an average of the rust area ratios of 7.5% or less was considered to be still better, and an average of the rust area ratios of 5.0% or less was considered to be the best.

Next, an initial permeability $\mu_i$ was measured. The winding number of a coil was set to 50 turns, and the initial permeability $\mu_i$ was measured by an LCR meter (LCR428A manufactured by HP). An initial permeability $\mu_i$ of more than 20.0 was considered to be good, but the object of the invention can be achieved even if the initial permeability $\mu_i$ was 20.0 or less.

TABLE 1

| | conditions of gradual oxidation treatment | | | | rust area ratio | |
|---|---|---|---|---|---|---|
| | temp. (° C.) | time (h) | WFe/Wsi | D (nm) | (%) | $\mu_i$ |
| Comp. Ex. 1 | — | — | — | 0 | 15.1 | 22.1 |
| Ex. 1 | 600 | 0.5 | 5.0 | 2 | 11.2 | 20.5 |
| Ex. 2 | 635 | 0.5 | 5.7 | 3 | 10.1 | 21.2 |
| Ex. 3 | 655 | 0.5 | 6.1 | 3 | 8.9 | 21.1 |
| Ex. 4 | 665 | 0.5 | 6.3 | 2 | 6.9 | 21.1 |
| Ex. 5 | 695 | 0.5 | 6.9 | 2 | 6.8 | 22.1 |
| Ex. 6 | 725 | 0.5 | 7.5 | 3 | 6.5 | 21.7 |
| Ex. 7 | 755 | 0.5 | 8.1 | 2 | 6.7 | 20.6 |
| Ex. 8 | 780 | 0.5 | 8.6 | 4 | 7.4 | 20.7 |
| Ex. 9 | 795 | 0.5 | 8.9 | 2 | 8.9 | 21.5 |
| Ex. 10 | 810 | 0.5 | 9.2 | 3 | 10.2 | 21.3 |
| Ex. 11 | 845 | 0.5 | 9.9 | 2 | 11.3 | 21.6 |

TABLE 2

| | conditions of gradual oxidation treatment | | | | rust area ratio | |
|---|---|---|---|---|---|---|
| | temp. (° C.) | time (h) | WFe/Wsi | D (nm) | (%) | $\mu_i$ |
| Comp. Ex. 1 | — | — | — | 0 | 15.1 | 22.1 |
| Ex. 21 | 727 | 0.5 | 7.6 | 2 | 7.4 | 22.1 |
| Ex. 22 | 727 | 1.0 | 7.2 | 3 | 6.5 | 21.9 |
| Ex. 23 | 727 | 1.1 | 7.4 | 4 | 6.3 | 21.9 |
| Ex. 24 | 727 | 1.3 | 7.4 | 5 | 4.9 | 21.7 |
| Ex. 25 | 727 | 1.6 | 7.7 | 7 | 4.5 | 21.6 |
| Ex. 26 | 727 | 1.9 | 7.4 | 9 | 4.1 | 21.7 |
| Ex. 27 | 727 | 2.2 | 7.5 | 11 | 3.8 | 21.5 |
| Ex. 28 | 727 | 2.8 | 7.5 | 15 | 4.3 | 21.6 |
| Ex. 29 | 727 | 4.3 | 7.7 | 25 | 4.2 | 21.6 |
| Ex. 30 | 727 | 4.9 | 7.4 | 29 | 3.9 | 21.3 |
| Ex. 31 | 727 | 5.8 | 7.4 | 35 | 4.2 | 21.4 |
| Ex. 32 | 727 | 6.4 | 7.3 | 39 | 4.6 | 20.8 |
| Ex. 33 | 727 | 6.8 | 7.4 | 42 | 4.4 | 20.7 |
| Ex. 34 | 727 | 7.7 | 7.3 | 48 | 4.7 | 20.1 |
| Ex. 35 | 727 | 8.0 | 7.5 | 50 | 4.1 | 18.4 |
| Ex. 36 | 727 | 10.0 | 7.5 | 70 | 4.1 | 17.5 |

Figure 4:
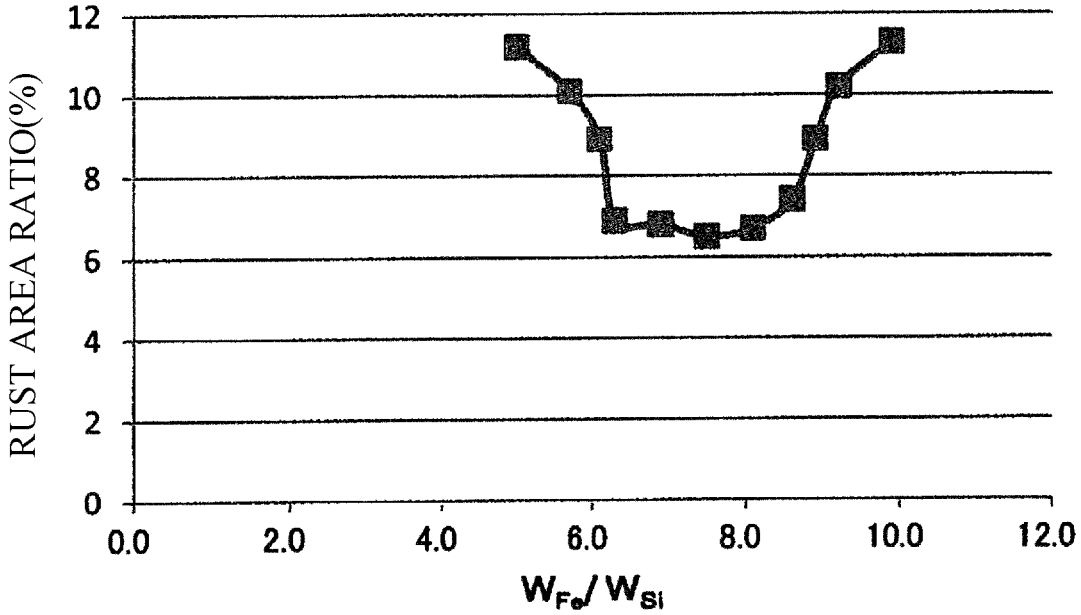
FIG. 4 is a graph showing a relation between $W_{Fe}/W_{Si}$ and rust area ratio in Examples of Table 1.

Examples 1 to 11 of Table 1 were an example where $W_{Fe}/W_{Si}$ was changed by adjusting a temperature condition of the gradual oxidation and controlling Si diffusion to the surface. FIG. 4 is a graph showing the results of Table 1.

According to Table 1, it is understood that all of Examples had an intermediate layer and had a good corrosion resistance and a good initial permeability. On the other hand, Comparative Example 1, where no intermediate layer was formed, had a corrosion resistance that was inferior to that of Examples.

Examples 3 to 9, where $6.0<W_{Fe}/W_{Si}<9.0$ was satisfied, had a better corrosion resistance. Moreover, Examples 4 to 8, where $6.3\leq W_{Fe}/W_{Si}\leq 8.6$ was satisfied, had a still better corrosion resistance.

Figure 5:
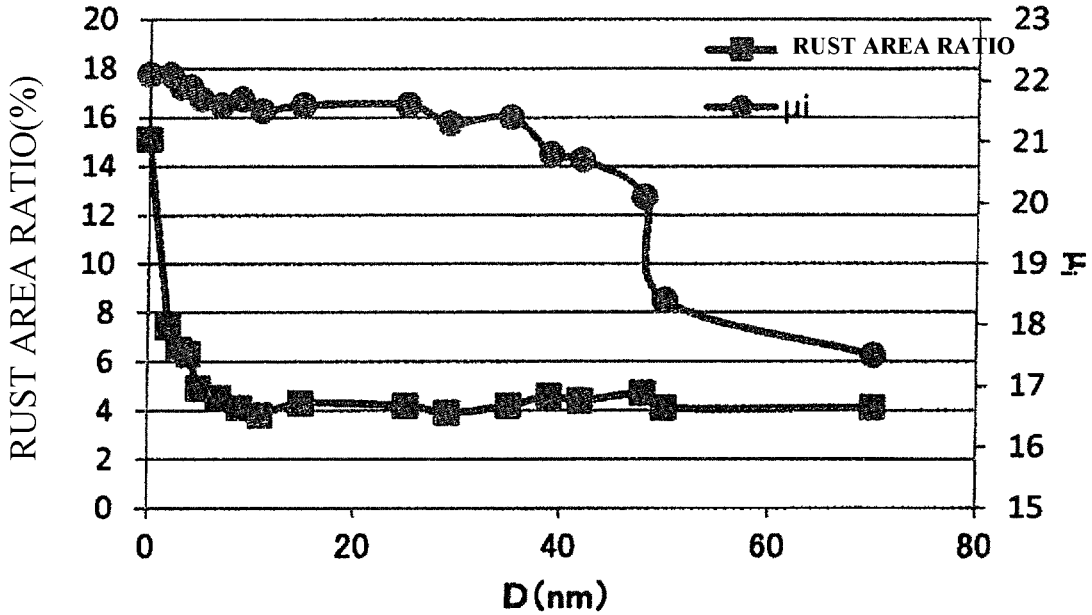
FIG. 5 is a graph showing a relation between "D", rust area ratio, and initial permeability $\mu_i$ of Examples and Comparative Examples of Table 2.

Examples 21 to 36 of Table 2 were an example where "D" was changed by controlling $W_{Fe}/W_{Si}$ between 7.2 and 7.6 and changing the gradual oxidation treatment time. FIG. 5 is a graph showing the results of Table 2.

According to Table 2, it is understood that all of Examples had a good corrosion resistance. In particular, Examples 24 to 36, where "D" was 5 nm or more, had a still better corrosion resistance, compared to Examples 21 to 23, where "D" was less than 5 nm.

Examples 21 to 34, where "D" was less than 50 nm, had a good initial permeability $\mu_i$ compared to Examples 35 and 36, where "D" was 50 nm or more.

NUMERICAL REFERENCES

1 . . . dust core
11 . . . metal magnetic material
11*a* . . . surface of metal magnetic material
12 . . . resin
13 . . . insulation film
14 . . . intermediate layer

The invention claimed is:

1. A dust core comprising:

a metal magnetic material;

a resin;

an insulation film covering the metal magnetic material; and an intermediate layer existing between the insulation film and the metal magnetic material and contacting therebetween, wherein the metal magnetic material comprises 85 to 99.5 wt % of Fe, 0.5 to 10 wt % of Si, and 0 to 5 wt % of other elements, with respect to 100 wt % of the entire metal magnetic material, wherein the intermediate layer comprises a Fe—Si—O based oxide, and wherein the insulation film comprises a Si—O based oxide.

2. The dust core according to claim 1, wherein $6.0<W_{Fe}/W_{Si}<9.0$ is satisfied, where $W_{Fe}$(wt %) is a Fe content of the intermediate layer, and $W_{Si}$(wt %) is a Si content of the intermediate layer, provided that a total of the Fe content and the Si content of the intermediate layer is 100 wt %.

3. The dust core according to claim 1, wherein 0<D<50 nm is satisfied, where "D" (nm) is a thickness of the intermediate layer.

4. The dust core according to claim 2, wherein 0<D<50 nm is satisfied, where "D" (nm) is a thickness of the intermediate layer.

5. The dust core according to claim 1, wherein the metal magnetic material is present in an amount of 90 wt % to 98 wt %, and the resin is present in an amount of 2 wt % to 10 wt %.

6. The dust core according to claim 1, wherein $6.1\leq W_{Fe}/W_{Si}\leq 8.9$.

7. The dust core according to claim 1, wherein $6.3\leq W_{Fe}/W_{Si}\leq 8.6$.

* * * * *